US005401551A

United States Patent [19]

Reese

[11] Patent Number: 5,401,551

[45] Date of Patent: Mar. 28, 1995

[54] SECURITY DEVICE

[76] Inventor: Robert S. Reese, 107 Manor Ave., Hempstead, N.Y. 11550

[21] Appl. No.: 217,444

[22] Filed: Mar. 24, 1994

[51] Int. Cl.[6] ..... A41D 19/00

[52] U.S. Cl. ..... 428/78; 2/20; 428/99

[58] Field of Search ..... D29/20, 113; 446/473; 273/150; 2/20; 428/78–99

[56] References Cited

U.S. PATENT DOCUMENTS

| | | | |
|---|---|---|---|
| 456,230 | 7/1891 | Wilson | 2/20 X |
| 1,360,840 | 11/1920 | White | 2/20 X |
| 2,820,318 | 1/1958 | Guyer | 446/473 |
| 5,273,607 | 12/1993 | O'Scanlon | 446/473 X |

*Primary Examiner*—Henry F. Epstein
*Attorney, Agent, or Firm*—Bauer & Schaffer

[57] ABSTRACT

A security device for preventing the unauthorized access to credit accounts accessible through electronic transaction systems includes a generally flat piece of material having a first surface on one face thereof. The first surface includes an opening extending along the plane of the one face from the first surface to a second surface on the other face of the piece of material. A generally flat strap extends in the opening and is secured at opposite ends thereof to the piece of material for manipulating the security device in relation to an electronic transaction system.

8 Claims, 2 Drawing Sheets

FIG. 4
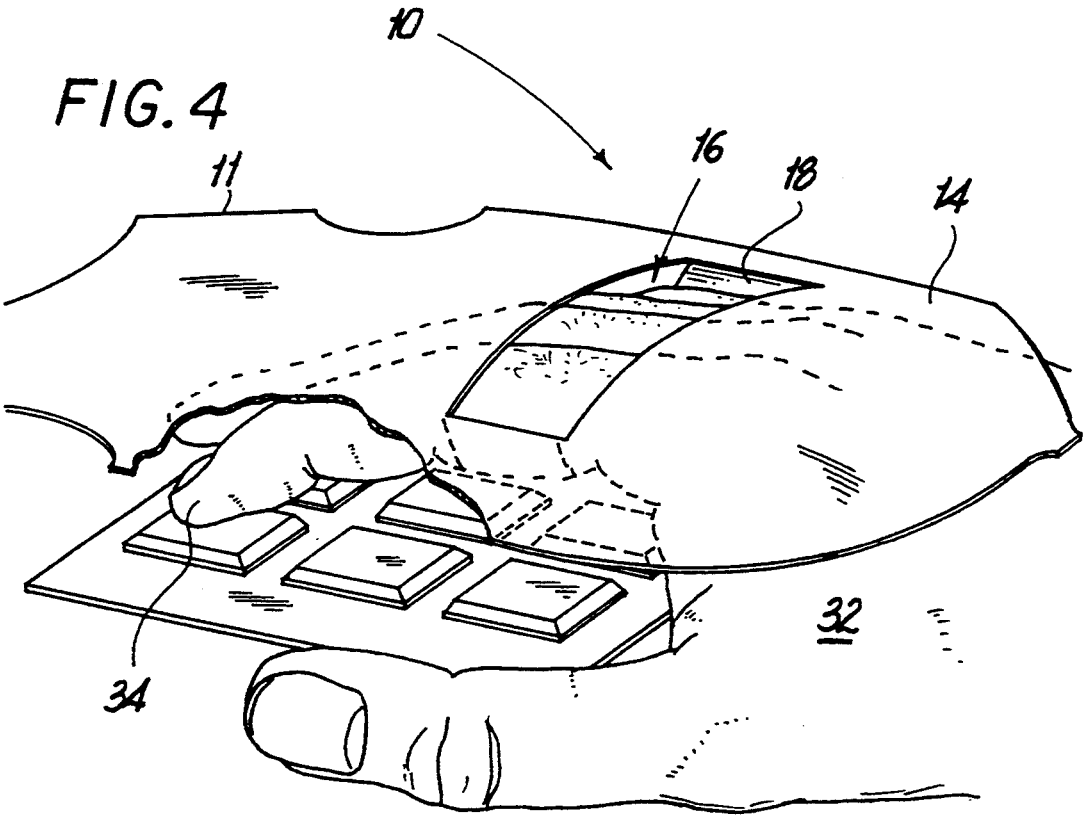
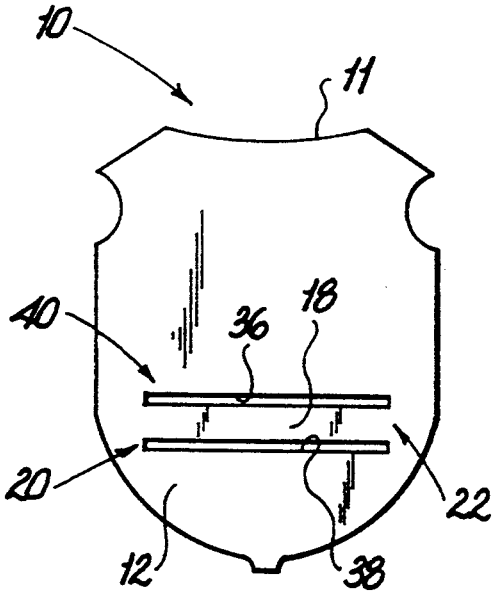
FIG. 5
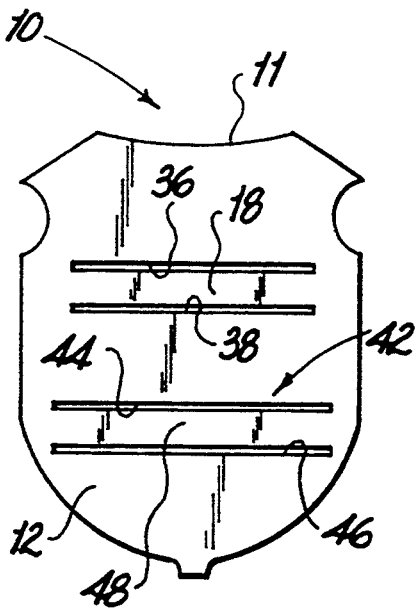
FIG. 6

SECURITY DEVICE

FIELD OF THE INVENTION

The present invention relates generally to the field of security access to structures, credit accounts, and the like and, more particularly, to a security device for improving the security of such structures and accounts.

BACKGROUND OF THE INVENTION

Electronic transaction systems are used today to permit consumers to conduct many day-to-day transactions in an efficient and rapid manner. For example, banks have recognized the importance of personalized direct electronic access of bank account information by individual customers by use of automatic teller machines (ATM). These machines provide customers with the ability to make inquiries as to their account balances and to direct that simple banking transactions be performed.

In this discussion, the term "transaction" will mean that activity for which a credit account is established to promote, e.g., the completion of a bank transaction through an automatic teller machine (ATM), the successful line connection between a calling party and the called party, or the unlocking of a door to a protected structure such as a building or automobile. The term "credit account" will be used as a generic term for any kind of account that is accessible to a user by entering account information and an access code. Such credit accounts include, but are not to be limited to, credit card accounts and telephone credit card accounts.

The above transactions are generally conducted by an authorized user entering account information and/or an access code by pressing a series of numerals and/or alphanumeric characters on a keypad which resembles, for example, a standard telephone keypad. Hence, such a keypad is generally found in an ATM, public telephones, and a door to a protected structure such as a building or automobile.

A critical problem arising as a result of conducting transactions via the abovementioned electronic transaction systems is the inevitable access of unauthorized users to certain credit accounts. As an example, telephone fraud has become a multimillion dollar per year revenue loss which is primarily paid for indirectly by its authorized users. In the Visa and MasterCard and Department Store credit card industries, the dollar losses are commensurate. To date, there is no apparent solution or countermeasure available to relieve these serious crimes. The bulk of the crimes come from the use of credit cards or credit card numbers that are stolen by the people through whose hands a credit card, or credit card number, passes, or by a person who observes someone making use of account information and a user identification code such as at a public telephone. It is not unusual for a credit card or credit card number to pass through a thousand hands per year.

Security of credit account systems has been improved in the last several years by the use of personal identification numbers (PINs). Although any of the aforementioned types of credit accounts could be used, the telephone credit card or "calling card" will be used to exemplify prior attempts to improve the security of credit accounts.

In the use of a calling card, the caller will enter the telephone number to be charged to his or her account. The system will then respond with a prompt for entry of the PIN. The PIN is a 4-digit number which is then compared against a stored 4-digit number in the computer of the phone company, and if a match is made between the entered PIN and the stored PIN, completion of the call will be made, and the cost for the call will be charged against the account recognized by the computer as being associated with the entered user phone number. If the incorrect PIN is entered, another request is made by the computer for entry of an appropriate PIN. If a successful match is made on the second or subsequent time, the call will be completed. After a certain number of attempted tries without success, any further attempts to enter a PIN will be rejected, even if a match would otherwise be made. The reason for not accepting entered PINs after a certain number of failures is to prevent unauthorized users from entering a large number of PINs at random in order to gain access to the account by a lucky match.

A similar system is employed by many banks in their ATM apparatus. Again, a user is prompted, after inserting his or her credit card into a slot, for a PIN, and upon a proper match, access to the account is made.

The problem with the above described systems is that it is not too difficult for one to gain access to an account by looking over the shoulder of a user entering numbers on a keypad which is usually mounted on a vertical panel and is easily seen by one who is serious about gaining access to an account. Although an ATM would require reading of the physical card prior to the user entering the PIN, telephone credit card account information and its access code can be obtained by an unauthorized user simply by observing the digits being entered and memorizing them or writing them down for future reference. This unauthorized observer is known as a phone surfer. In a more extreme, although not uncommon, situation, an unauthorized user might steal a calling card or rob its owner of such card after the unauthorized user learns the access code or PIN.

The result of an unauthorized user successfully entering a credit account is that he is rewarded and encouraged to try again with another credit account. Further, once the access code for a particular account is known, the unauthorized user can repeatedly use the account over and over until such time as he or she is caught, decides to move on to another account, or exhausts the credit limit of the legitimate owner of the account.

In an attempt to reduce the possibility of an unauthorized user gaining access to an account by looking over the shoulder of a legitimate user entering the account information into an electronic access system, the following solutions have been proposed: make access codes longer, thus rendering it more difficult for unauthorized users to observe and memorize or write down account information; cancel the codes of employees once they leave a company; train personnel to recognize the signs of rip-off schemes; block all calls to countries in which the company has no dealings; monitor calling on a daily basis; increase hired security personnel to guard protected structures; and the like. Not only have these attempted efforts resulted in excessive costs to industries providing credit account services, but they have also failed to make a significant reduction in such crimes.

It would therefore be an improvement in this industry to provide a security device for frustrating or eliminating the ability for an unauthorized user to gain access to a protected structure or credit account.

It is an object of the present invention to provide a security device for improving the security in electronic access transactions and in some cases to completely eliminate the possibility of fraudulent access.

Another object of the present invention is to provide a security device which is relatively small and compact and light in weight for convenience in handling and which significantly restricts unauthorized access yet keeping legitimate accessing simplistic for an authorized user.

It is yet another object of the present invention to provide a security device which is extremely simple and durable in structure for high reliability throughout a long useful life, and which can be economically manufactured for sale at a reasonable price.

SUMMARY OF THE INVENTION

Briefly stated, the present invention is a security device for preventing unauthorized access to credit accounts accessible through electronic transactions systems. The security device includes a generally flat piece of material including a first surface on one face thereof having an opening extending along the plane of the one face from the first surface to a second surface on the other face of the piece of material. A generally flat strap extends into the opening and is secured at opposite ends thereof to the piece of the material for manipulating the protective device in relation to an electronic transaction system. The strap and the opening define a pair of slits on the first and second surfaces of the piece of material.

BRIEF DESCRIPTION OF THE DRAWINGS

The foregoing summary, as well as the following detailed description, will be better understood when read in conjunction with the appended drawings. For the purpose of illustrating the invention, there is shown embodiments which are presently preferred, it being understood, however, that this invention is not limited to the precise arrangements and instrumentalities shown. In the drawings:

FIG. 4 is a front perspective view partially broken away, illustrating a user's hand in place;

FIG. 5 is a front elevational view of a second embodiment of a security device in accordance with the present invention; and FIG. 6 is a front elevational view of a third embodiment of a security device in accordance with the present invention.

DETAILED DESCRIPTION OF PREFERRED EMBODIMENTS

While this invention is susceptible of embodiments in many different forms, this specification and the accompanying drawings disclose only some specific forms as examples of the use of the invention. The invention is not intended to be limited to the embodiment so described, and the scope of the invention will be pointed out in the appended claims.

Figure 1:
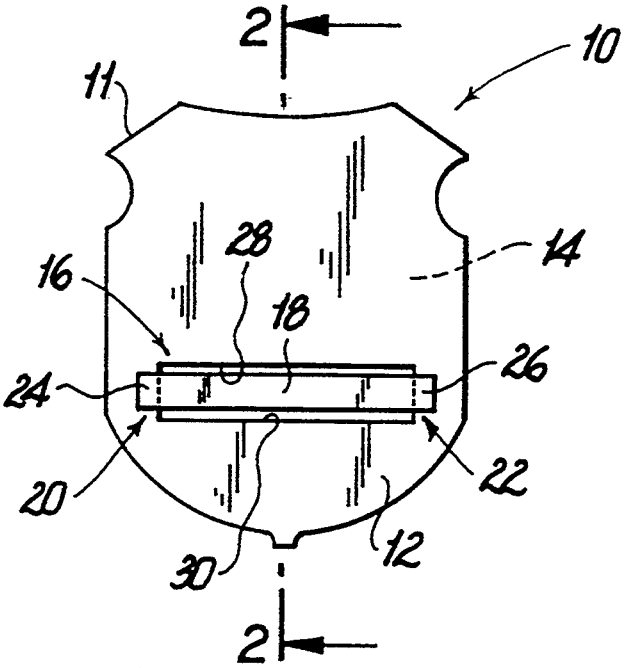
FIG. 1 is a front elevational view of a first embodiment of a security device in accordance with the present invention.

Referring now to the drawings in detail, wherein like numerals are used to indicate like elements throughout, there is shown in FIG. 1 a first embodiment of a security device, generally designated 10, for preventing unauthorized access to credit accounts accessible through electronic transaction systems (not shown) which incorporates, for example, a keypad having a series of numerals and alphanumeric characters. Such keypad are commonly found, for example, in an automatic teller machine, where it is used to complete banking transactions, in public telephones, where it provides for the successful connection between a calling party and the called party, and in protected structures such as buildings and automobiles.

The security device 10 comprises a generally flat piece of material 11 including a first surface 12 on one face thereof and a second opposite surface 14 on the other face. An opening 16 extends along the plane of the first surface 10 to the second surface 14. A generally flat strap extends in the opening 16 and is secured at opposite ends 20, 22 by securing means 24, 26, respectively, for manipulating the security device 10 as further described below. The opening 16 and strap 18 define a pair of slits 28, 30.

Preferably, the piece of material 11 is fabricated of a flexible paper product, such as octag paper. However, it is understood by those skilled in the art that other materials are suitable for the piece of material 11. For example, the material could be a suitable cloth, vinyl or other flexible plastic which is light in weight yet rigid enough to permit manipulation by a user as further described below.

In the present embodiment, the security device 10 is constructed by cutting the opening 16 on the piece of material 11 with a suitable cutting tool, such as a knife or pair of scissors, and securing the generally flat strap 18, preferably fabricated of the same material, to the piece of material 11 by suitable securing means 22, 24. Preferably, the securing means 22, 24 comprises an adhesive. However, it will be understood by those skilled in the art that other types of securing means are available to secure the strap 18 to the piece of material 11. For example, a clip, button or Velcro connection could be used to secure the strap 18 to the piece material 11 without departing from the spirit and scope of the invention.

In the present embodiment, and the embodiments to be further described below, the security device 10 employs the configuration of a shield and the opening 16 is rectangular in shape. However, it is understood by those of ordinary skill in the art that the security device 10 and the opening 16 could be of any polygonal or curved configuration without departing from the spirit and scope of the invention.

Figure 2:
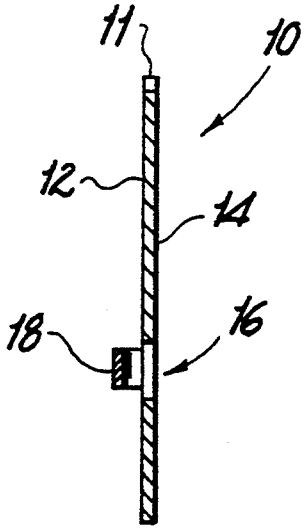
FIG. 2 is a cross-sectional view of the security device shown in FIG. 1 taken along lines 2—2 of FIG. 1.

Referring now to FIG. 2, the generally flat profile of the security device 10 is illustrated. The flat profile conveniently provides for a relatively small and compact device which is light in weight and thus convenient in handling. The strap 18 is preferably of a thickness equal to the thickness of the piece of material 11 such that when not in use, the strap lies within the opening 16 without protruding from either surface 12, 14. In FIG. 2, however, the strap 18 is shown to extend from the second surface 14, illustrating the position when the security device 10 is in use as further described below.

Figure 3:
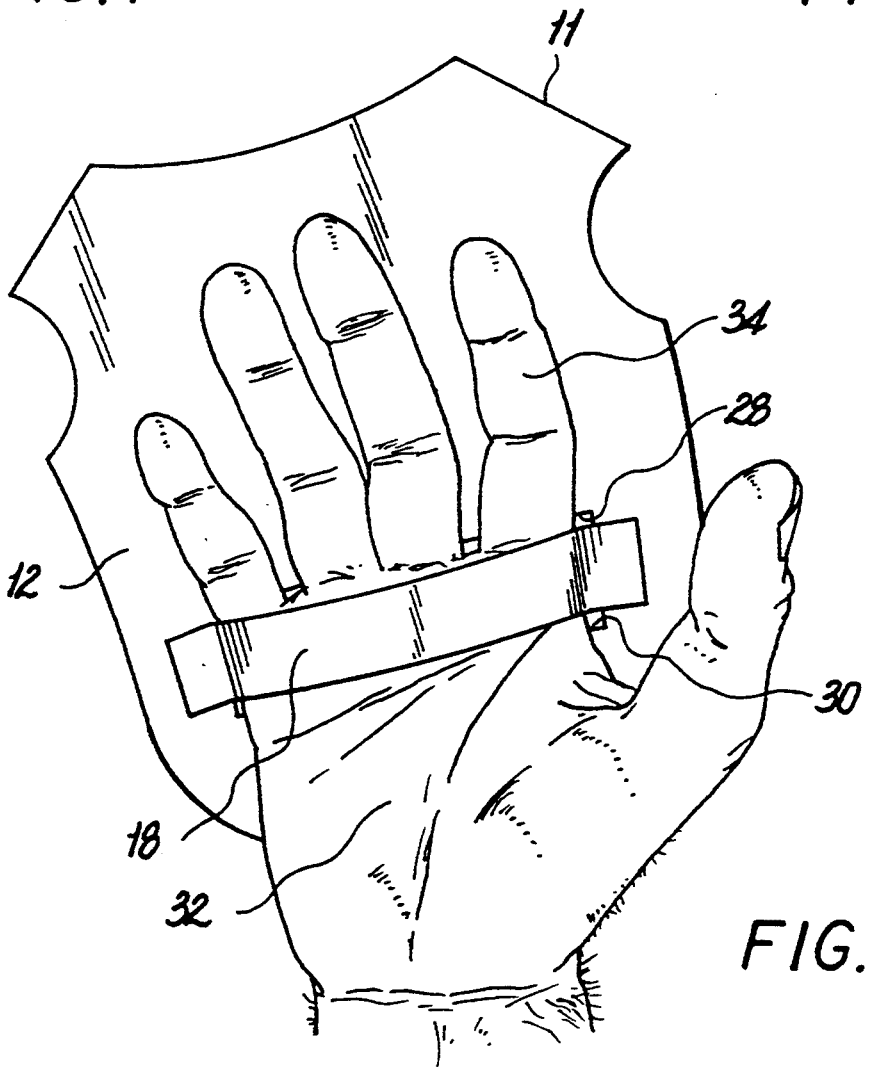
FIG. 3 is a rear elevational view of the security device, illustrating a user's hand in place.

The use of the security device 10 will be described with reference to FIGS. 3 and 4. As shown in these figures, the security device 10 is adapted to be supported and manipulated by a user's hand 32. Prior to conducting a "transaction", e.g., a banking transaction through an automatic teller machine (ATM), a telephone call on a public telephone, the unlocking of a door to a protected structure, which is effected by entering an access code on a keypad usually mounted on a vertical panel, a legitimate user manually grips the strap 18 from the second surface 14 of the piece of material with four fingers 34 as shown in FIG. 3. The security device 10 is then supported and able to be freely manipulated by the hand 32 while the fingers 34 are free to be manipulated to enter the appropriate access code information. The legitimate user then manipulates the device 10 towards the keypad, with the second surface 14 facing the keypad (FIG. 4), orienting the device so as to obstruct any view of the keypad by someone looking over the shoulder of the user. Hence, the security device 10 effectively allows a legitimate user to conduct a transaction in a simplistic manner while preventing unauthorized users from viewing the numbers or alphanumeric characters being inputted by the legitimate user.

It is understood by those skilled in the art that the security device 10 is also adapted to be employed in transactions where the keypads are mounted in a manner other than on a vertical panel. For example, a legitimate user may utilize the security device when inputting numbers on a keypad which is oriented horizontally with respect to a support surface, such as a desk telephone or a keypad on a computer keyboard.

A security device according to a second preferred embodiment of the invention, as shown in FIG. 5, includes the essential elements of the device previously described with reference to FIGS. 1–4. However, in the second embodiment the ends 20, 22 of the strap 18 are formed integrally with the piece of material 11. The present embodiment is conveniently constructed by cutting two parallel slits 36, 38 with a suitable cutting tool as recognized in the art so as to define an opening 40 and the strap 18.

The security device 10 according to the second embodiment of the invention, as shown in FIG. 5, is operated in a manner identical to the security device previously described with reference to FIGS. 1–4.

A security device according to a third embodiment of the invention, as shown in FIG. 6, includes the essential elements of the device previously described with reference to FIG. 5. However, in the third embodiment a second opening 42, defined by a pair of slits 44, 46, extends along the plane of the first surface 12 of the piece of material 11 from the first surface to the second surface 14 thereof and in a direction parallel to the first opening 36. The slits 44, 46 define a second strap 48 which provide for enhanced manual support of the security device 10 as further described below.

The security device 10 according to the third embodiment, as shown in FIG. 6, is operated essentially in the same manner as the device previously described with reference to FIG. 5. The only difference is that a legitimate user causes his hand to simultaneously engage both straps 18, 48, whereby support and manipulation of the security device 10 is enhanced.

It is understood by those of ordinary skill in the art that a second opening 16 and strap 18, as described with reference to the embodiment of FIG. 5, could be incorporated into the embodiment of FIGS. 1–4 for the purpose of enhancing the support and manipulation of the security device 10.

From the foregoing, it is readily understood that the security device 10 described above with reference to FIGS. 1–6 can be used to significantly restrict unauthorized access to access codes inputted into electronic transaction systems while keeping legitimate accessing simplistic of the same for an authorized user. In addition, the security device 10 is relatively small and compact, light in weight for convenience in handling, extremely simple and durable in structure for high reliability throughout a useful life, and economically manufactured for sale at a reasonable price.

From the foregoing description, it can be seen that the present invention comprises a security device for preventing the unauthorized access of credit accounts accessible through electronic transaction systems. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A hand-held security device for preventing the unauthorized access to credit accounts accessible through electronic transaction systems, said security device comprising:

a) a generally flat piece of material including a first surface on one face thereof, said first surface including an opening extending along the plane of said one face from said first surface to a second surface on the other face of said piece of material; and b) a generally flat strap extending in said opening and secured at opposite ends thereof to said piece of material, said strap permitting the user to place the palm of the hand in said strap with the back of hand in contact with said other face and with the fingers freely movable to manipulate an electronic device while being hidden from view by said flat piece of material.

2. The device according to claim 1, wherein said opposite ends of said strap are formed integrally with said piece of material.

3. The device according to claim 1, further comprising securing means for securing said opposite ends of said strap to said piece of material.

4. The device according to claim 1, wherein said first surface further includes a second opening extending along the plane of said one face from said first surface to said second surface in a direction parallel to said first opening, and further including a second strap extending in said second opening and secured at opposite ends thereof to said piece of material for the insertion of the user's fingers.

5. The device according to claim 2, wherein said first surface further includes a second opening extending along the plane of said one face from said first surface to said second surface in a direction parallel to said first opening, and further including a second strap extending in said second opening and secured at opposite ends thereof to said piece of material.

6. The device according to claim 3, wherein said first surface further includes a second opening extending along the plane of said one face from said first surface to said second surface in a direction parallel to said first opening, and further including a second strap extending in said second opening and secured at opposite ends thereof to said piece of material.

7. The device according to claim 1, wherein said piece of material and said strap are fabricated of a flexible plastic.

8. The device according to claim 1, wherein said piece of material and said strap are fabricated of a paper material.

* * * * *